United States Patent [19]

Bivens

[11] 4,180,850

[45] Dec. 25, 1979

[54] RETRACTABLE LIGHT FIXTURE

[75] Inventor: Jon A. Bivens, Upland, Calif.

[73] Assignee: The Toro Company, Riverside, Calif.

[21] Appl. No.: 920,407

[22] Filed: Jun. 29, 1978

[51] Int. Cl.[2] ..... F21V 19/02

[52] U.S. Cl. ..... 362/285; 362/145; 362/147; 362/258; 362/372; 362/385; 362/387; 362/418

[58] Field of Search ..... 362/145, 147, 258, 285, 362/372, 418, 385, 387

[56] References Cited

U.S. PATENT DOCUMENTS 2,738,492 3/1956 Arneson et al. ..... 362/285 X

*Primary Examiner*—Stephen J. Lechert, Jr.

*Attorney, Agent, or Firm*—Poms, Smith, Lande & Rose

[57] ABSTRACT

A hydraulically operated retractable light fixture is disclosed particularly adapted for decorative landscape lighting applications, lighting walks and pathways, and exterior area lighting applications. A retractable hollow member carrying a light bulb is disposed to retract into a hollow body which can be buried in the ground or mounted to exterior wall or ceiling surfaces. A hydraulic line is attached to the housing for forcing the retractable member out of the housing when lighting is desired. Various modifications are shown for creating special lighting effects.

14 Claims, 12 Drawing Figures

RETRACTABLE LIGHT FIXTURE

BACKGROUND OF THE INVENTION

The present invention relates to light fixtures, primarily light fixtures adapted for exterior lighting applications, and more particularly to light fixtures adapted for movement between operating positions and retracted positions.

The use of exterior lighting is quite popular, particularly in the southwestern or "sunbelt" states of the United States wherein much activity takes place out of doors after dark because of the weather and wherein lighting is used to accentuate the extensive decorative landscaping employed because of the favorable year around weather conditions. In recent years, so-called "low voltage lighting" has become particularly popular for decorative lighting inasmuch as lower voltage and lower wattage bulbs provide a pleasant light atmosphere with low power consumption and long-life attendant the equipment.

Most lighting fixtures employed for the aforementioned purpoes still remain ugly, inconvenient, and, in many cases, unsafe. Fixtures placed in the lawn adjacent a sidewalk or pathway present objects over which a person may fall when attention is not specifically directed thereto as by the lighting thereof. Mowing around such fixtures in the lawn becomes an inconvenient task requiring separate attention with hand shears or a powered edger adapted for such use.

Wherefore, it is the object of the present invention to provide a lighting fixture for the aforementioned purposes which retracts to a virtually unseen (therefore not ugly) position and which additionally provides no safety hazard or inconvenience at times when a lighting fixture is not being employed to light an adjacent area.

SUMMARY

The foregoing objectives have been met by the retractable lighting fixture of the present invention which comprises a conduit housing closed on one end and open on the opposite end, the housing having an inlet adapted for connection to a source of fluid under pressure and a sealable passageway therethrough disposed adjacent the closed end; a hollow member disposed in sealed sliding relationship within the housing and adapted to slide through the open end between a first position retracted into the housing and a second position at least partially extended out of the housing, the member being biased towards the first position and adapted to move to the second position against the bias when fluid under pressure is applied to the inlet, the member having a sealable passageway therethrough disposed to be within the housing when the member is in either of the aforementioned two positions; a light bulb carried by the member; and, an electrical connector operable connected to the light bulb on one end and adapted on the other end for connection to an appropriate source of electrical energy for illuminating the bulb, the connector being disposed to pass through the sealable passageways in the housing and the member to the outside of the housing. In the preferred embodiment, a plurality of such fixtures are shown connected to a common source of fluid pressure and an electrical power source under the control of an automated timing circuit whereby the fixtures are extended and electrically activated at preselected times for preselected intervals.

DESCRIPTION OF EXEMPLARY AND PREFERRED EMBODIMENTS

Figure 1:
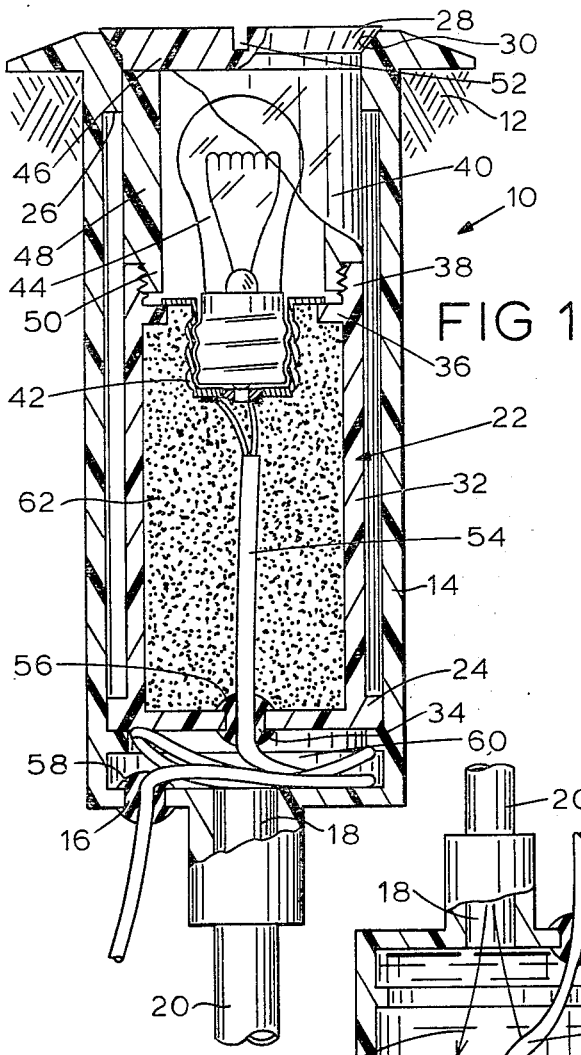
FIG. 1 is a cut-away side elevation of a lighting fixture according to one embodiment of the present invention shown in its retracted state when employed in a below-ground application.

Referring first to FIG. 1, a "pop-up" configuration of the present invention, generally indicated as 10, is shown buried in the ground 12. Fixture 10 comprises a cylindrical body 14, preferably of one of the high impact plastics. In fact, except for those pieces particularly stated as being of other materials, the various embodiments of the present invention are constructed entirely of high impact plastics to provide ease of manufacture, low cost, non-corrosion, reliability of operation, and long life. Cylindrical body 14 is open at the top end and closed at the bottom end. A sealable passageway 16 is provided through the closed end for the sealed passage therethrough of an electrical cable to be described hereafter. A hydraulic inlet 18 is also provided in the closed end for the attachment of a hydraulic line 20 to body 14 as by any appropriate fastener.

A hollow moving member generally indicated as 22, is disposed in sliding relationship within the cylindrical body 14. Hollow moving member 22 is provided with a circumferential sealing and stop ridge 24 adjacent the bottom end. Ridge 24 provides two purposes. First, it seals the area between hydraulic inlet 18 and hollow moving member 22 against fluid leaks to cause hollow moving member 22 to react as a piston to the introduction of hydraulic pressure through hydraulic line 20 and inlet 18 into cylindrical body 14. Ridge 24 also is adapted to contact a mating ridge 26 disposed internally circumferentially about the top of cylindrical body 14 to prevent the complete movement of member 22 out of body 14. Thus, the total longitudinal movement of hollow moving member 22 out of cylindrical body 14 is determined by the combined positioning of ridge 26 and ridge 24. A second angled stop ridge 28 is disposed circumferentially about the top of hollow moving member 22 to contact a correspondingly angled shoulder 30 on the top of cylindrical body 14 to prevent hollow moving member 22 from moving into cylindrical body 14 greater than flush with the surface thereof so as to present a smooth upper surface when the lighting fixture is in the retracted position shown in FIG. 1. Hollow moving member 22 is comprised of two portions.

The lower portion 32 has a closed bottom end having a sealable passageway 34 therethrough similar to the sealable passageway 16 of body 14. The upper end of lower portion 32 has a partition 36 thereacross and has a threaded collar 38 along the upper edge thereof adapted to receive the upper portion 40 of member 22. A light bulb socket 42 is attached to the partition 36. Light bulb socket 42 is adapted to removably receive a light bulb 44 so that the light bulb 44 extends into the area to be occupied by the upper portion 40. It is preferred that the light bulb be of the low voltage type employing less than 30 volts of power for the illumination thereof. In addition to the long life and hazard reducing benefits attendant the use of low voltage bulbs in such lighting applications, there are additional benefits attendant such choice as will become apparent hereinafter.

The upper portion 40 of member 22 comprises a cylindrical side portion 48 having a threaded bottom end 50 adapted for mating with threaded collar 38 of lower portion 32 and a top 46 closing the other end. A slot 52 is conveniently proviced in the top 46 for the insertion of a coin or the like for ease of turning upper portion 40 for its removal from lower portion 32 or reattachment thereto. At least side portion 48 is of a transparent or translucent plastic to allow the passage of light therethrough to the desired degree. Optional variations in upper portion 40 will be discussed in greater detail hereinafter.

Figure 2:
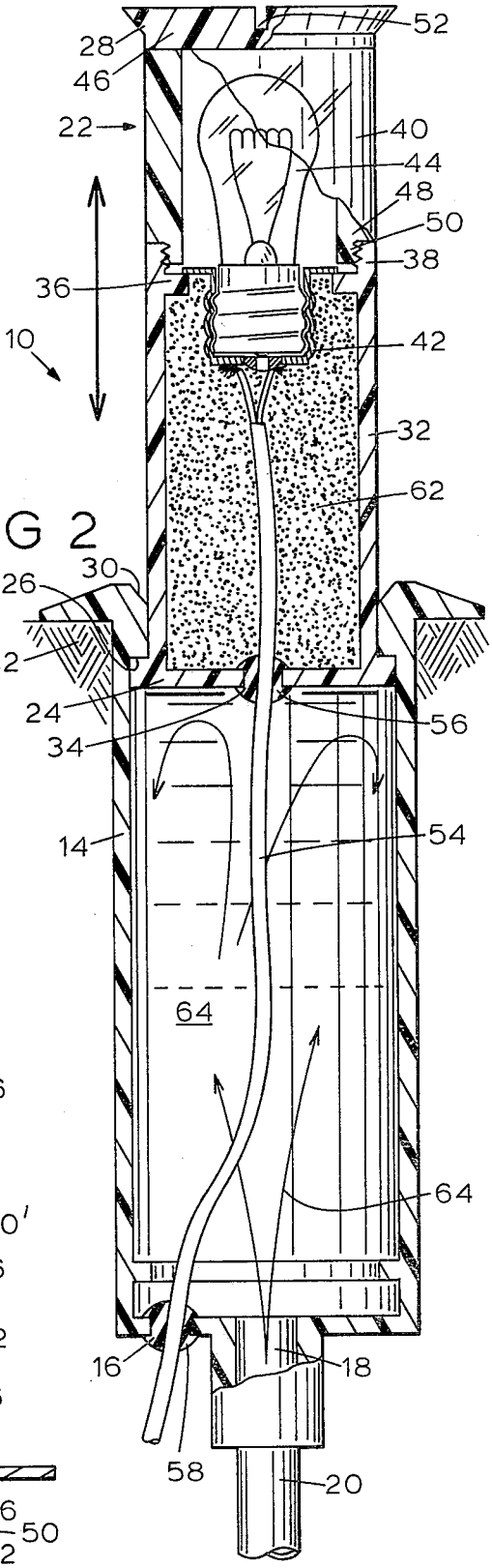
FIG. 2 is a cut-away elevation of the lighting fixture of FIG. 1 shown in its extended position.

Socket 42 has an electrical connector 54 operably connected thereto on one end as by soldering. Connector 54 is then passed through sealable passageway 34 and sealed by an appropriate sealing material 56. Electrical connector 54 is then disposed to continue on through body 14 to pass through sealable passageway 16 for electrical connection on the opposite end to an appropriate source of power. The passage of electrical connector 54 through sealable passageway 16 is also sealed by an appropriate sealing material 58. At least that portion of electrical connector 54 between sealable passageway 16 and sealable passageway 34 should be flexible enough to fold into an area 60 provided therefore as shown in FIG. 1 by having the length of hollow moving member 22 be less than the length of cylindrical body 14. The folding portion of connector 54 preferably is of the preformed recoiling plastic type (such as used on some telephones or the like) to assure continued non-interfering recoiling into area 60 as the movable member 20 is moved between the extended position of FIG. 2 and the retracted position of FIG. 1.

In this embodiment, it is desirable that, lower portion 32 internally between partition 36 and sealable passageway 34 be filled with an appropriate insulating "potting" compound to provide both absolute water-tight insulation of socket 42 and added weight to moving member 22. Being thus weighted by potting compound 62, moving member 22 is biased by gravity to the retracted position of FIG. 1 when disposed in the "pop-up" configuration of FIG. 1 and 2. As can thus be seen, therefore, when low pressure hydraulic fluid (e.g. water) 64 is introduced into body 14 through inlet 18, moving member 22 is raised to the position of FIG. 2 as determined by the position of stop ridges 24 and 28 previously described. In some installations it may be found to be desirable to add additional sealing means (not shown) to be disposed between ridges 24 and 28 when the fixture 10 is in the raised position of FIG. 2 to prevent any possible leakage of the hydraulic fluid 64 therebetween.

Figure 3:
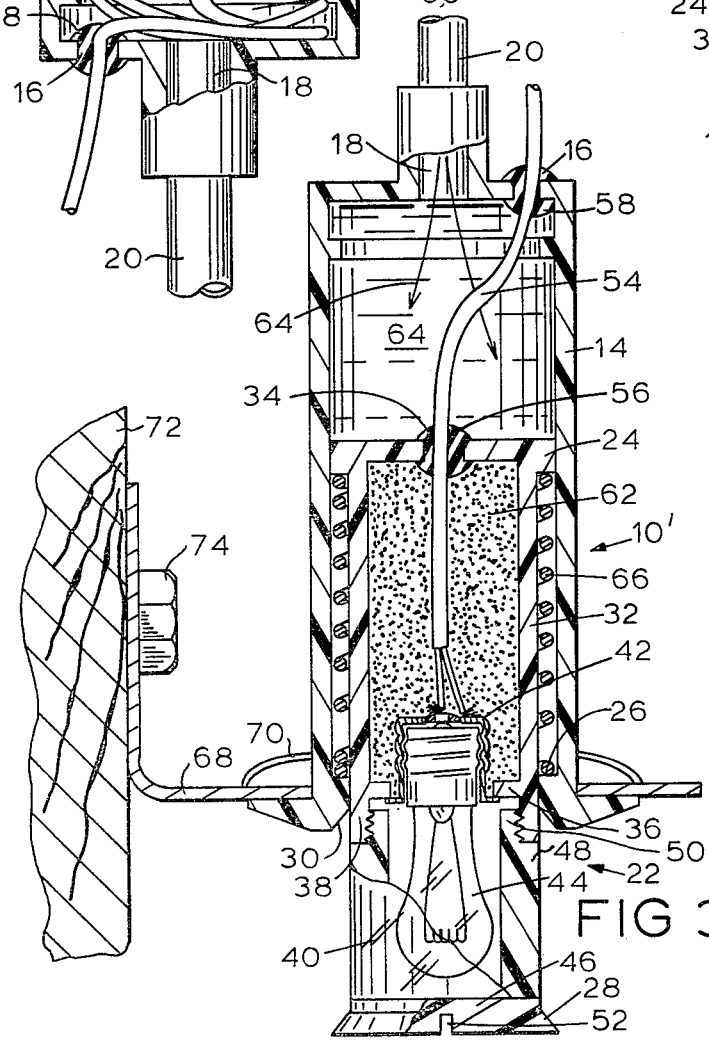
FIG. 3 is a lighting fixture according to another embodiment of the present invention mounted by a bracket to extend vertically downward for lighting and to retract vertically upward into an overhead position when retracted.

Referring now to FIG. 3, a "pop-down" fixture 10' is shown as a second embodiment of the present invention. Fixture 10' is substantially identical to the fixture 10 previously described in relation to FIGS. 1 and 2 except for the addition of a spring 66 disposed concentrically about moving member 22 between ridges 24 and 26, so as to urge moving member 22 against the force of gravity up into cylindrical body 14 to the retracted position. Spring 66, of course can also be used in a "pop-up" fixture and is, actually, preferred. Fixture 10' is conveniently held in such an inverted position by the addition of an appropriate bracket 68 held by a spring clip 70 which then can be attached such as to a wooden beam 72 with a lag bolt 74 or the like.

Referring now to FIGS. 5 through 10, various envisioned modifications to upper portion 40 are shown. For example, in FIG. 5, upper portion 40 is provided with a removable internal cylindrical sleeve 76. Sleeve 76 of FIG. 5 incorporates a number of options which can be used singly or in combination. Sleeve 76 is preferably of a plastic material. Thus, the plastic sleeve 76 could be of a colored translucent nature to provide subdued lighting. Additionally, sleeve 76 has a transparent area 78 therein for the unobstructed passage of light therethrough. Transparent area 78 could, of course, be provided either by using transparent material in the area or by a hole or slot cut into the wall of sleeve 76 at the desired location. Additionally, a metallic reflector 80 is provided along one wall interior of sleeve 76. Reflector 80 is adapted to redirect the light beams 82 through the transparent area 78. It will be understood that such a metallic reflector could be provided by itself and that the transparent area could be employed without the use of a corresponding reflector 80. Additionally, cylindrical sleeve 76 could be constructed of a shiny metallic material such as thin wall stainless steel tubing having a slot cut therein so as to provide the transparent area 78 whereby an integral reflector 80 would be provided.

Additionally, metalic reflector 80 can conveniently be provided on the inner surface of a plastic cylindrical sleeve 76 by the dispersion coating of fine metallic particles such as aluminum according to techniques well known in the plastic forming and finishing art.

Figure 6:
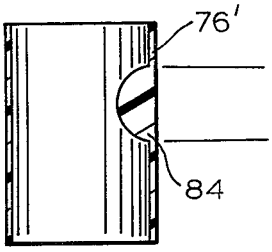
FIG. 6 is a cut-away elevation through a sleeve adapted for insertion in the manner of the sleeve of FIG. 5 and containing an integral lens portion for forming light passing therethrough.
Figure 10:
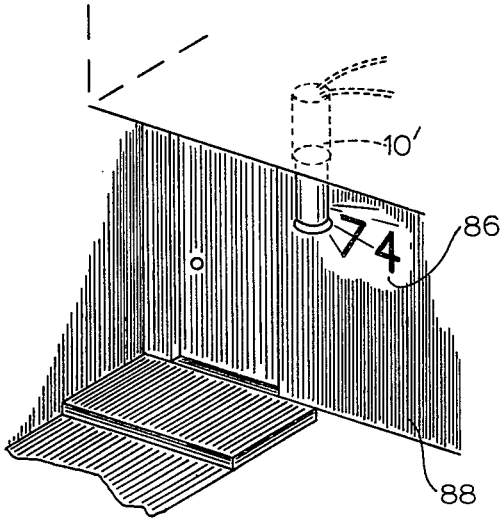
FIG. 10 is a simplified drawing of the entry to a building showing the lighting fixture of the present invention in an overhead mounted position and incorporating integral lens means therein for selectively directing light to illuminate only the building numbers.

FIG. 6 shows a plastic sleeve 76' incorporating an integral lens area 84 therein. By darkening the inner surface of the sleeve 76' except at one or more selected lens areas 84, selectively lighting of spot areas (such as shown in FIGS. 10) can be accomplished. In FIG. 10, a "pop-down" fixture is shown selectively lighting only the house numbers 86 of a house 88.

Figure 7:
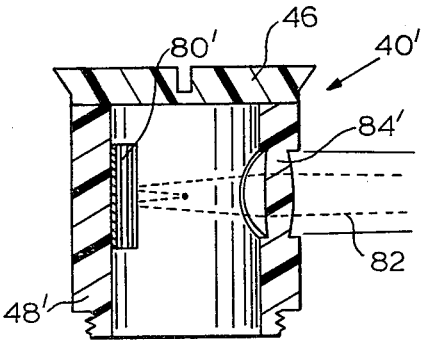
FIG. 7 is a cut-away elevation through the light bulb containing portion of the light fixture of the present invention showing modifications thereto wherein integral reflecting and lens means are provided for redirecting and shaping the light emanating from the fixture.

Referring now to FIG. 7, a modified upper portion 40' is shown directly incorporating some of the features previously provided by the addition of the removable sleeves 76 and 76'. For example, a metallic reflector 80' is shown affixed to the inner wall of the side portion 48' of upper portion 40'. As previously discussed, reflector 80' could be a metallic reflector affixed to the inner wall of side portion 48' as with an appropriate adhesive or by the dispersion coating of metallic particles directly thereon. A lens area 84' is also formed directly into the sidewall 48' of upper portion 40' to converge the light beams 82. As mentioned in relation to FIG. 6, the interior of upper portion 40' could be darkened except in the area of one or more lens areas 84' to provide a selective spot lighting fixture such as that employed in FIG. 10 for the selective lighting of the house numbers 86 only.

Figure 8:
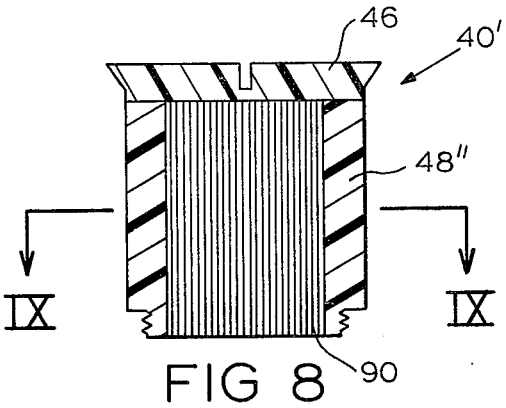
FIG. 8 is a cut-away elevation of the light bulb containing portion of the present invention having the interior surface thereof textured to diffuse light passing therethrough.
Figure 9:
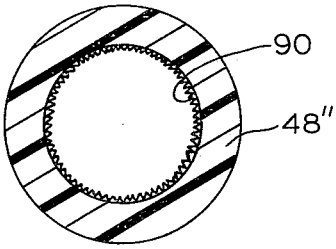
FIG. 9 is a cut-away plan view of the lighting fixture portion of FIG. 8 in the plane IX—IX.

In FIGS. 8 and 9, the sidewalls 48'' of a modified upper portion 40'' are shown to be textured as by the use of serrations 90 longitudinally therein so as to provide a softened or diffused lighting effect from the fixture.

Figure 4:
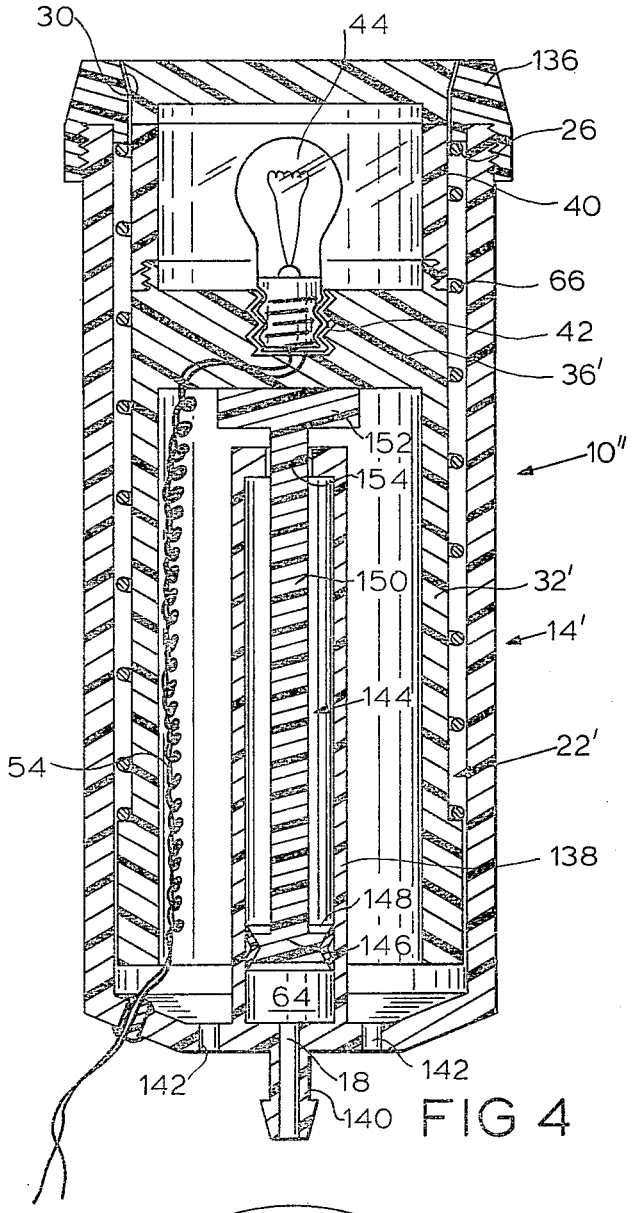
FIG. 4 is a cut-away side elevation of the preferred embodiment of the present invention in its retracted state.

Turning now to FIG. 4, the present invention is shown in its preferred embodiment wherein the electrical and hydraulic functions are physically separated one from another. The fixture, generally indicated as 10'', comprises a cylindrical body 14' having a cylindrical hollow moving member 22' disposed therein for longitudinal movement between extended and retracted positions in a manner similar to the previously described embodiments.

Body 14' has a collar 136 threaded on the upper end providing the angled shoulder 30 and ridge 26. By removing the collar 136, the moving member 22' can be removed and replaced for servicing. A hydraulic cylinder 138 is disposed concentrically within the body 14' being connected on the lower end to the hydraulic inlet 18. Note that in the preferred embodiment the hydraulic inlet 18 includes a barbed connector 140 particularly adapted for hydraulic connection with plastic tubing or the like. Note also that the bottom of body 14' is sloped inwardly toward drain holes 142 passing therethrough whereby any fluid which should enter body 14' can drain out.

Moving member 22' is similar to member 22 of the embodiment of FIG. 3 in that it is biased to the retracted position by a spring 66. Member 22' includes an upper portion 40 substantially identical to those hereinbefore described. The lower portion 32', however, is open at the bottom end whereby to pass concentrically about the hydraulic cylinder 138. The potting compound 62 of the previous embodiments is eliminated and, instead, the partition 36' separating the upper portion 40 and the lower portion 32' is thickened and formed with the light bulb socket 42 sealed therein. The electrical cable 54 connected to the socket 42 is also sealed into the partition 36' and emerges therefrom to pass between lower portion 32' and the hydraulic cylinder 138 to the bottom of body 14' from whence it emerges to be connected to an appropriate source of electrical power. As before, it is preferred that cable 54 be of the self-coiling variety so as to extend and contract along with the extending and retracting actions of member 22' without fouling.

To provide the isolated extending power for member 22', a piston and rod assembly 144 is operably disposed within hydraulic cylinder 138. Assembly 144 comprises a piston 146 having a circumferentially disposed rubber or soft plastic hydraulic seal 148 disposed for longitudinal movement within hydraulic cylinder by the introduction of hydraulic fluid 64 from inlet 18. An actuator rod 150 connects piston 146 to a ram head 152 in contact with the bottom of the partition 36'. As shown, the actuator rod 150 slidably passes through a guide hole 154 coaxially disposed in the end of hydraulic cylinder 138. As can thus be seen, in the preferred embodiment the hydraulic fluid 64 is retained within the hydraulic cylinder 138 between the inlet 18 and the piston 146 and never comes in contact with any of the electrical components.

Figure 12:
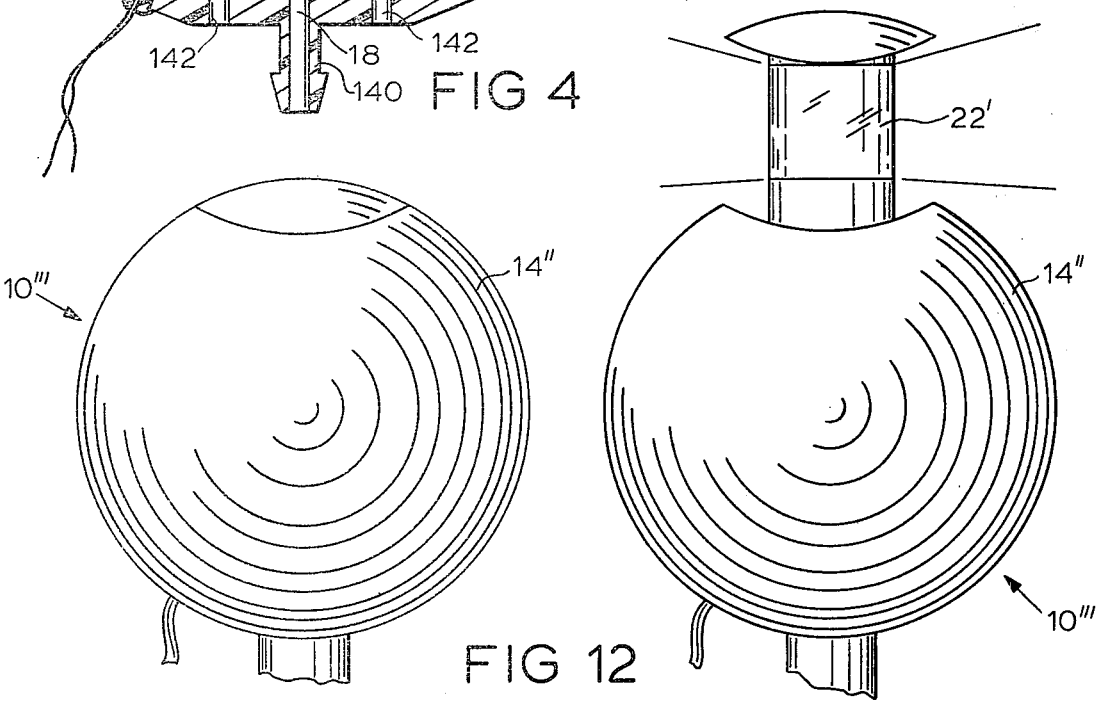
FIG. 12 is a simplified drawing of a spherical bodied embodiment of the present invention in its retracted and extending states.
Figure 5:
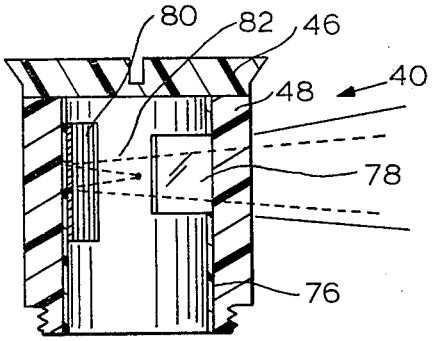
FIG. 5 is a cut-away elevation of the light bulb containing portion of the present invention showing a sleeve adapted for removable insertion therein containing both light-limiting and light-reflective means for modifying the light pattern emanating from the light fixture of the present invention.

It should be appreciated that in the preferred embodiment the body 14' and movable member 22' need not be cylindrical inasmuch as the sealed relationship is maintained between the piston 146 and cylinder 138. If desired, therefore, body 14' and member 22' can be of various shapes in cross-section for decorative purposes such as rectangular, hexagonal, or the like. For example, see FIG. 12 showing a fixture 10''' having a spherical body 14'' containing a cylindrical moving member 22'.

Figure 11:
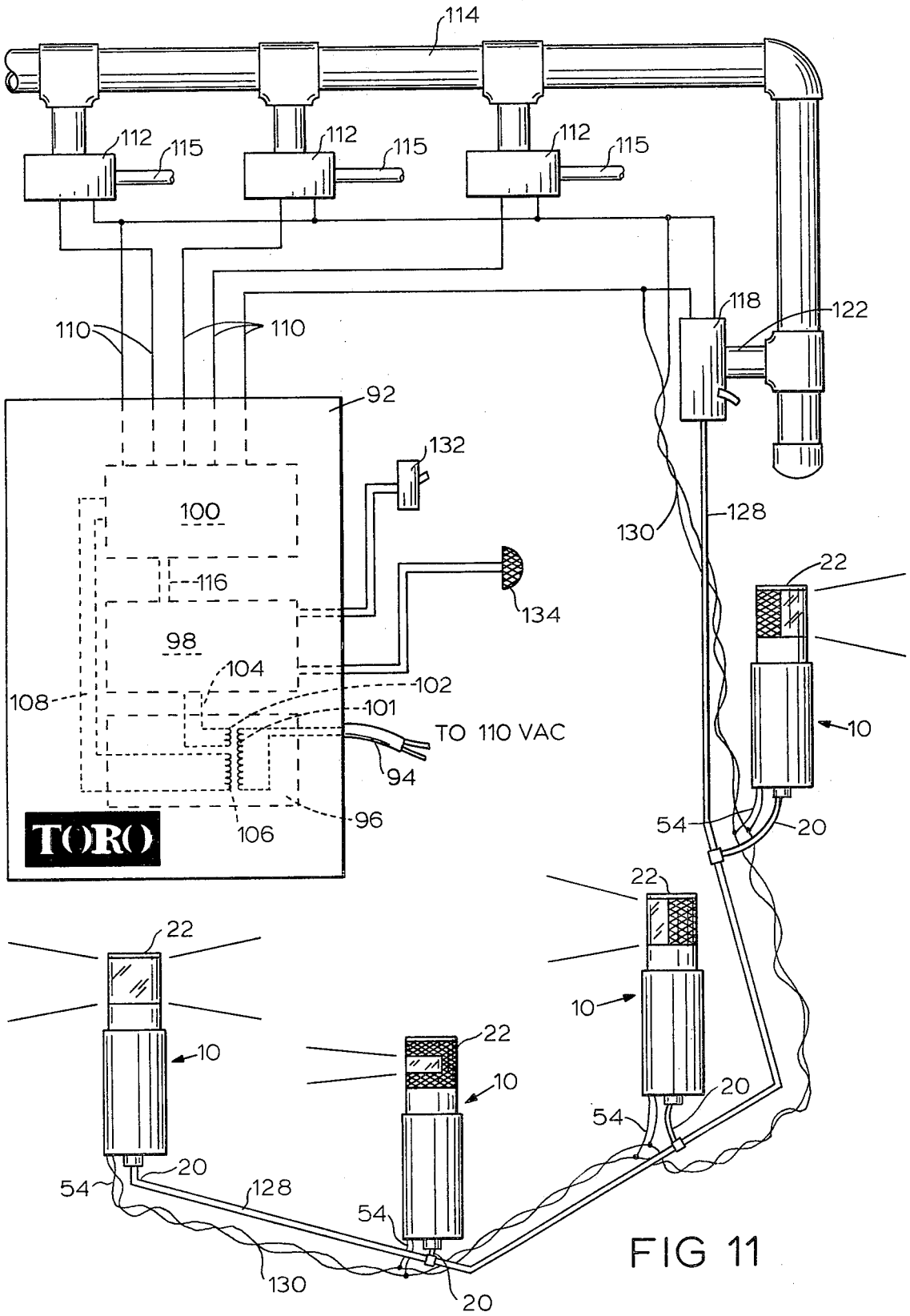
FIG. 11 is a simplified drawing of a plurality of lighting fixtures according to the present invention interconnected to be controlled by a solid state controller to effect simultaneous extension and activation of the lighting fixtures at preselected times and for preselected durations.

Having thus shown the lighting fixture of the present invention along with various optional modifications possible thereto to derive uniquely applicable benefits useful in particular lighting applications, attention is drawn to FIG. 11 wherein a plurality of fixtures 10 according to the present invention are interconnected and operated by a solid state controller. While a lighting system employing the fixtures of the present invention could be activated with manual valves and switches or with a conventional timer system, the hydraulic/low voltage operation makes operation by a solid state device particularly suitable as will be recognized from the description which follows hereinafter. Solid state controllers particularly adaptable for controlling such lighting fixtures in combination with automated sprinkling apparatus to provide sprinkling and/or lighting of a landscape areas at preselected times and for preselected durations are shown in the copending applications "Automatic Irrigation Sprinkler System Controller" by T. L. Kendall, et al, Ser. No. 866,049 filed Dec. 30, 1977 and "Simplified Irrigation Controller " by T. L. Kendall, Ser. No. 900,911, filed May 22, 1978, assigned to the common assignee of this application.

Such a solid state controller as modified for the present application is indicated as 92 in FIG. 11. The controller 92 has an electrical connector 94 adapted for connection to a commercial 110 VAC source of power (not shown). Controller 92 also incorporates three major subassemblies therein—a power spply 96, logic circuitry 98, and an output driver 100. The electrical connector 94 is connected to the primary 101 of a transformer within power supply 96. One secondary 102 of the transformer provides 9 volts DC which is connected by power lines 104 to the logic circuitry 98 to provide power therefor. Another secondary 106 provides 28 volts AC connected by power lines 108 to the output driver 100 for use thereby. In the application of the controller 92 for sprinkler applications as described in the aforementioned copending U.S. patent applications, output driver 100 is connected through a plurality of output lines 110 to a plurality of sprinkler stations 112 connected between a water main 114 and individual sprinkler lines 115 for conducting water to selected areas to be irrigated thereby.

The logic circuitry 98 maintains a list of start and duration times for activating the individual sprinkler stations 112. At the designated times, logic circuitry 98 sends a logic signal to the output driver 100 through logic lines 116 which causes output driver 100 to use the 28 volts AC supplied on power line 108 to output a 28 volt AC control signal on the appropriate output lines 110 connected to the selected sprinkler station 112 whereby the path between the water main 114 and the sprinkler line 115 is opened so as to provide water from main 114 to the selected irrigation area. Thus, the controller 92 provides both a controlled source of 28 volts AC usable in illuminating the low voltage bulbs 44 preferred for incorporation in the fixtures 10 of the present invention and a controlled source of hydraulic fluid (i.e irrigation water) for raising or lowering the movable member in pop-up and pop-down applications respectively. These are, of course, the two elements required by the lighting fixture of the present invention.

In FIG. 11, controller 92 is shown adapted to control a plurality of pop-up fixtures 10 disposed throughout a landscape area. The simultaneous controlling of irrigation functions is shown, but optional. A pair of the output lines 110 are connected to control a 3-way hydraulic solenoid valve 118 and are used for illuminating the bulbs 44 disposed within the fixtures 10 as well.

The inlet of the hydraulic solenoid valve 118 is connected by a conduit 122 to the water main 114 to provide a source of pressurized water for the lighting system. The output of hydraulic solenoid valve 118 is connected to the fluid main 128. The functions of the 3-way hydraulic valve 118 can be provided as well by several 2-way valves provided in series. Valve 118 is adapted to provide a low pressure fluid source at its output for use in raising the movable members 22 of fixtures 10. Additionally, valve 118 is adapted to relieve any remaining pressure in the line connected to its output through overflow tube 126 in the manner of a relief valve when the pressurized supply at its input is removed.

The output of valve 118 is connected to a low pressure fluid main 128 which is preferably of a small diameter flexible plastic tubing which can be easily maneuverable throughout a garden area or the like. The hydraulic lines 20 of fixtures 10 are operably connected to the low pressure fluid main 128.

The previously discussed output lines 110 of controller 92 also have a low voltage power pair cable 130 connected thereto disposed to be placed throughout the area to the lighted in conjunction with low pressure fluid main 128. The electrical cables 54 of fixtures 10 are operably connected to the low voltage power pair 130.

As thus configured and connected, when the output lines 110 connected to hydraulic solenoid valve 118 and the electrical cables 54 are activated by the appropriate 28 volts AC signal, solenoid valve 118 is opened to, thereby, deliver a low pressure fluid supply of water through main 128 to the fixtures 10 to raise the moving members 22 as shown in FIG. 4. Simultaneously, the 28 volts AC passes to the low voltage power pair 130 whereby the bulbs 44 within fixtures 10 are illuminated. Upon removal of the 28 volts AC signal from the output lines 110 connected to hydraulic solenoid valve 118, the power to the low voltage power pair 130 is also removed causing the bulbs 44 to be extinguished. Simultaneously, the output of hydraulic solenoid valve 118 is closed off. The relief valve of valve 118 then causes the fluid within low pressure fluid main 128 to be drained through overflow tube 126 at least in sufficient quantity to allow moving members 22 to be moved by the bias force of the spring 66 to the retracted position.

In applications of the controller 92 for lighting purposes, it may be found desirable to connect a manually operable switch 132 and/or a light-operated sensor 134 to controller 92 for manual operation of the light fixtures 10 or automatic activation thereof under conditions of lack of sufficient illumination within the area as sensed by the sensor 134. This could be accomplished by connecting switch 132 and sensor 134 to the logic circuitry 98 to be sensed thereby or by direct connection thereto into the output driver portion 100 to override logic circuitry 98.

Thus, it can be seen from the foregoing description that the light fixture of the present invention has truly met its stated objectives by providing a remotely extendable and retractable lighting fixture adapted for retraction into a housing adapted for implantation within the ground, floors, walls, and ceilings to provide a safe and virtually unseen fixture when in its retracted position.

Wherefore, having thus described my invention, I claim:

1. A retractable light fixture comprising:

(a) a hollow body having an opening into said body;

(b) a movable member disposed within said opening and adapted to slide through said opening between a first position retracted into said body and a second position at least partially extended out of said body, said movable member being biased toward said first position;

(c) hydraulic means having an inlet adapted for connection to a source of fluid under pressure for moving said movable member to said second position against said bias when fluid under pressure is applied to said inlet;

(d) a light bulb carried by said member; and, (e) an electrical connector operably connected to said light bulb on one end and adapted on the other end for connection to an appropriate source of electrical energy for illuminating said bulb, said connector being disposed to allow said member to move between said positions and passing from said bulb through said body to the exterior of said body.

2. The retractable light fixture of claim 1 wherein:

(a) said body is a cylinder closed on one end and open on the opposite end to form said opening, said body having said inlet adapted for connection to a source of fluid under pressure and a sealable passageway therethrough disposed adjacent said closed end;

(b) said movable member is a cylinder disposed concentrically in sealed sliding relationship within said body and adapted to slide along the common longitudinal axis through said open end between said first position retracted into said housing and said second position at least partially extended out of said body whereby said hydraulic means includes said member operating as a hydraulic piston within said body acting as a hydraulic cylinder, said movable member having a sealable passageway therethrough disposed to be within said housing when said member is in either of said positions; and, (c) said electrical connector operably connected to said light bulb on one end and adapted on the other end for connection to an appropriate source of electrical energy for illuminating said bulb is disposed to pass through said sealable passageways in said body and said member from said bulb to the outside of said body.

3. The retractable light fixture of claim 2 or 14 wherein:

said movable member has two segments and includes means for removably connecting said light bulb carried by a partition dividing said member into said two segments whereby said light bulb is disposed within one of said two segments, at least said segment having said light bulb therein being of a material to allow the passage of light therethrough.

4. The retractable light fixture of claim 3 wherein:

said segment having said light bulb therein includes means for directing light therefrom in a selected direction.

5. The retractable light fixture of claim 4 wherein:

said directing means comprises a removable sleeve adapted to be disposed around said bulb within said segment containing said bulb, said sleeve having a transparent area where light is to emerge.

6. The retractable light fixture of claim 5 wherein:

said sleeve includes reflecting means disposed within said sleeve for directing light from said bulb towards said transparent area.

7. The retractable light fixture of claim 5 wherein:

said sleeve includes lens means disposed in said transparent area for concentrating light passing therethrough from said bulb.

8. The retractable light fixture of claim 3 wherein:

said segment containing said light bulb therein is removable from said other segment and said partition whereby said light bulb can be replaced.

9. The retractable light fixture of claim 3 wherein:

said segment containing said ight bulb therein is textured to diffuse light passing therethrough.

10. The retractable light fixture of claim 3 wherein:

said segment containing said light bulb therein contains integral lens means for concentrating and directing light from said light bulb passing therethrough.

11. The retractable light fixture of claim 3 wherein:

said segment containing said light bulb therein includes reflecting means for redirecting a portion of the light from said light bulb in a different direction.

12. The retractable light fixture of claim 1 wherein:

said movable member is hollow and is partially filled with insulating potting material means for sealing the electrical connections to said light bulb from contact by water and for supplying weight to said movable member whereby said bias force is provided by gravity.

13. The retractable light fixture of claim 1 and additionally comprising:

spring means operably connected for accomplishing said biasing of said hollow member towards said first position.

14. The retractable light fixture of claim 1 wherein said hydraulic means comprises:

(a) a hydraulic cylinder integrally formed within said body and having said inlet passing through said body in communication with said cylinder;

(b) a piston disposed within said cylinder for sealed movement by hydraulic fluid under pressure applied to said inlet; and, (c) actuator rod means disposed between said movable member and said piston for moving said movable member to said second position against said bias in combination with said piston when hydraulic fluid under pressure is applied to said inlet.

* * * * *